United States Patent [19]

Morris

[11] Patent Number: 4,669,992

[45] Date of Patent: Jun. 2, 1987

[54] RECREATIONAL WATERSLIDE WITH SEAT

[76] Inventor: Richard M. Morris, 20620 60th Ave. West, Lynnwood, Wash. 98036

[21] Appl. No.: 788,058

[22] Filed: Oct. 16, 1985

[51] Int. Cl.[4] ..... A63C 15/00

[52] U.S. Cl. ..... 441/65; 114/363; 297/195; 297/423; 297/458

[58] Field of Search ..... 441/65, 72; 114/363; 280/18; 297/461, 458, 195, 423

[56] References Cited

U.S. PATENT DOCUMENTS

| | | | |
|---|---|---|---|
| 3,561,025 | 2/1971 | Teach | 441/65 |
| 3,635,490 | 1/1972 | Demaree | 280/18 |
| 3,769,645 | 11/1973 | Lettman | 114/363 |
| 3,863,978 | 2/1975 | Gillings, Jr. | 297/195 X |
| 4,028,761 | 6/1977 | Taylor | 441/65 |
| 4,377,309 | 3/1983 | Mengshoel | 297/423 |

*Primary Examiner*—Sherman D. Basinger
*Attorney, Agent, or Firm*—Christensen, O'Connor, Johnson & Kindness

[57] ABSTRACT

A recreational waterslide having a board (10) adapted to skim across the surface of a body of water and a seat (20) secured to the upper surface of the board so as to support a rider in a seated, kneeling position. The upper portion of the seat is spaced a predetermined distance from the upper surface of the board to elevate the buttocks of the rider above his ankles and transfer the rider's body weight forward. Concavely contoured side portions (50, 52) of the seat permit the rider to grip the seat between his legs for control while riding and to grip the seat with elbows and forearms for control when starting in the water.

8 Claims, 4 Drawing Figures

RECREATIONAL WATERSLIDE WITH SEAT

BACKGROUND OF THE INVENTION

The present invention relates generally to water-skimming devices and, more particularly, to a recreational waterslide that is ridden by a user while being pulled behind a boat.

Over the years, various board-like, water-skimming devices have been developed for recreational purposes. Some of these boards have been directly connected to a boat with a towline, while others have been free-floating, requiring that the rider balance himself on the board while holding onto a towrope of the type used for water-skiing. This latter category of devices has enjoyed the most popularity, primarily because of the challenges presented to a rider.

Although this type of board is enjoyable to ride, it has several disadvantages. First, the rider must "sit" in an unnatural kneeling position such that his body weight is supported mainly by his knees and ankles. Since the ankles and knees are not accustomed to supporting weight in this fashion, discomfort results. Secondly, by its very nature, the act of being pulled behind a boat produces stress on the lower back. The only practical way for the rider to relieve this stress is to lean backwards. In these circumstances, however, leaning backwards causes two problems. The first is increased and almost unbearable strain on the ankles. The second is increased "bouncing", i.e., the front end of the board slapping up and down for no apparent reason, even in smooth water.

SUMMARY OF THE INVENTION

The present invention overcomes the disadvantages of the developments described above. In particular, the invention provides a recreational waterslide comprising a board having a lower surface that is constructed and arranged to skim across the surface of a body of water. The board also includes an upper surface that is adapted to be mounted by a rider. A seat is secured to the upper surface of the board and positioned so as to engage the buttocks of a rider and support the rider when he is in a kneeling position. In a preferred form, an upper portion of the seat is spaced a predetermined distance from the upper surface of the board such that the buttocks of the rider are elevated above his ankles. As a consequence of this arrangement, the body weight of the rider is lifted off of his ankles, knees, and shins and transferred, instead, through his buttocks to the board. This arrangement results, as well, in the rider's body weight being transferred slightly forward, a factor that reduces the amount of "bounce". According to an aspect of the invention, the seat is positioned so as to be straddled by the legs of the rider and is provided with grips on two opposed sides. In the simplest, and most preferred, form, the grips comprise surface portions, on opposite sides of the seat, which curve concavely inward. Since, with this construction, the seat can be effectively pinched between the legs of the rider, substantially more control and handling results. In addition, the presence of the seat, in general, and the presence of grippable surfaces thereon, in particular, permit the rider to lean back comfortably, lessening the strain on the lower back.

The seat also facilitates mounting the board when in the water. Rather than having his chest flush against the board, as is necessary with prior devices, the rider is able to rest his chest upon the seat during the initial mode of operation when he is being accelerated from a stationary, prone condition to a speed at which the board is skimming across the water. Since the seat raises the rider's chest off of the upper surface of the board, it is much easier for the rider to slide his knees from behind the board into the kneeling, riding position. In addition, by squeezing the seat with his elbows and forearms, the rider can control an initial side-to-side swaying of the board that is prevalent when starting in the water.

DETAILED DESCRIPTION OF THE PREFERRED EMBODIMENT

Figure 3:
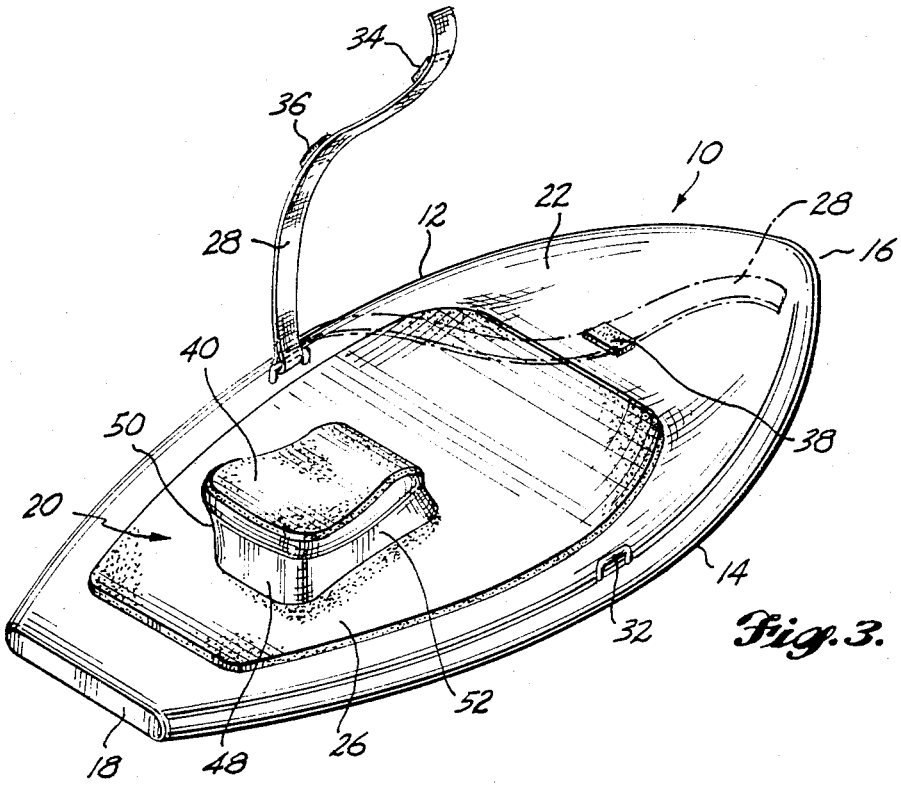
FIG. 3 is a perspective view of the waterslide of FIG. 1.
Figure 4:
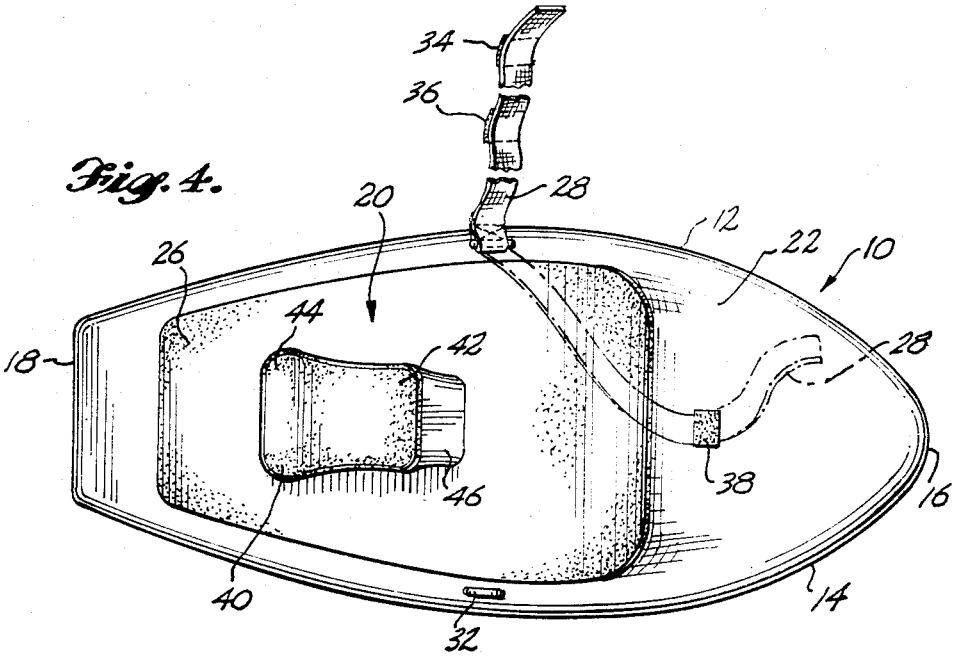
FIG. 4 is a plan view of the waterslide of FIG. 1.

Referring initially to FIG. 3, a recreational waterslide according to the present invention includes a board 10 and a seat 20 that are preferably formed as a single piece of molded plastic material. As seen in FIG. 3 and the plan view of FIG. 4, the port and starboard side edges 12 and 14, respectively, of the board define a boat-like shape. When viewed from above, the bow of the board arcs broadly from a blunted prow 16 to an intermediate portion, which has the widest transverse dimension and which is located rearwardly from the prow a distance that is equal to approximately one-third of the overall length of the board. From this intermediate portion, the board tapers in a very gradual manner to a generally flattened stern 18.

Figure 1:
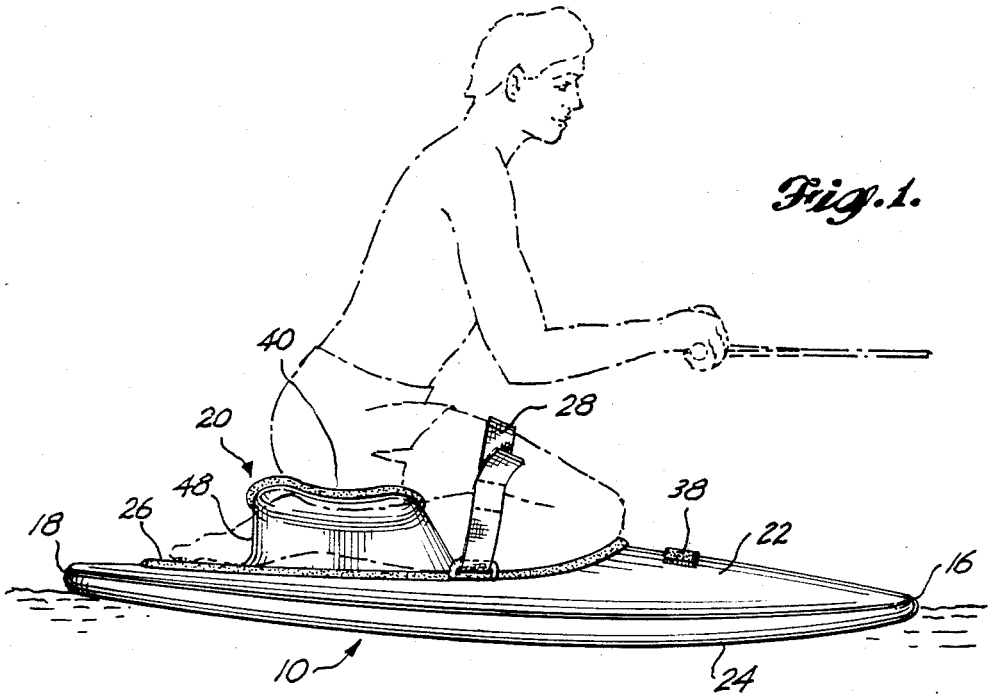
FIG. 1 is a side elevation view of a recreational waterslide according to the invention with a rider shown in the riding position.

The board includes an upper surface 22 and a lower surface 24 that curve smoothly into one another around the entire side periphery of the board. The lower surface curves slightly from port to starboard and from stern to bow in a hydrodynamic manner so as to be adapted to skim or glide across the surface of a body of water. A depression, or well, 26 is formed in the upper surface of the board to constitute the cockpit in which the rider positions himself in a seated, kneeling position while traveling across the water. As seen best in FIG. 1, the rear two-thirds of the well 26 are substantially flat, while the forward third curves smoothly upward, following a thickening of the top-to-bottom dimension of the board. This depression is covered with a layer of foam to provide a soft, grippable surface for the rider's knees, lower legs, and feet.

To assist in holding the rider on the board, the waterslide includes a strap 28 that may be releasably connected across the rider's legs. The strap is permanently secured to a loop 30 on one side of the board and releasably securable to another loop 32 on the opposite side of the board. Cooperating fastening means, such as Velcro patches 34 and 36, hold the belt in place when the same is looped around tie loop 32. When starting in the water, the Velcro patch 34 is engaged with another Velcro patch 38 on the upper surface of the board so as to place the strap in a safe, out-of-the-way position, as indicated in reference lines in FIGS. 3 and 4.

The seat 20 is positioned on the depression 26 a small distance rearward of the transverse centerline of the board and symmetrically disposed about the longitudinal centerline of the board, which runs through the center of the prow 16. The seat includes a saddle-shaped upper surface 40 that curves concavely downward between front and rear peak portions so as to be engageable with the buttocks of a rider. As seen from above, in FIG. 4, the transverse dimension of the seat in the vicinity of the forward peak 42 is less than the transverse dimension of the seat in the vicinity of the rear peak 44. As well, the port and starboard lateral side edges of the upper surface of the seat have a gradual, inwardly concave curvature between the forward and rear peaks. The front portion 46 of the seat slopes downwardly from the forward peak 42 to the well 26. The rear portion 48 of the seat lies substantially in a vertical plane.

Figure 2:
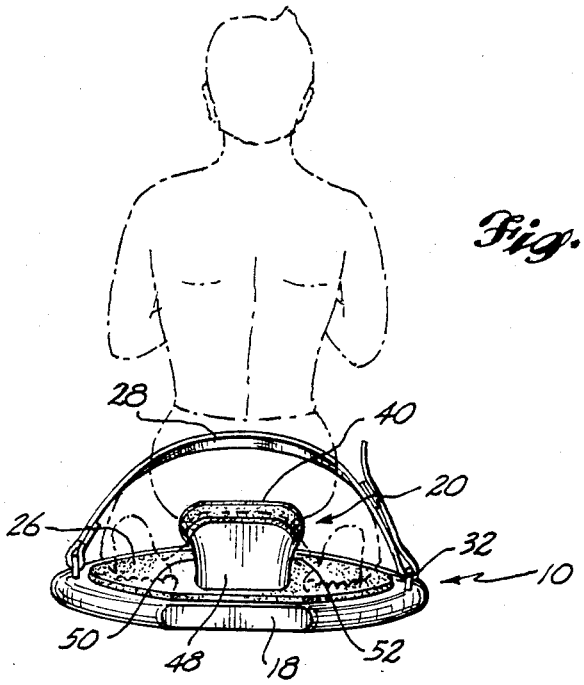
FIG. 2 is a rear elevation view of the waterslide of FIG. 1.

As seen best in FIG. 2, the port side portion 50 and starboard side portion 52 curve concavely inward from the upper surface 40 of the seat to the well 26 of the board. Consequently, the seat is seen to have a base portion of reduced dimension relative to the upper portion thereof. This configuration provides several advantages. First, the curved side portions 50 and 52 provide means whereby the rider may securely grip the waterslide by "pinching" the seat between his lower legs. In contrast to prior skimming devices, this arrangement affords significantly better control and handling. A second advantage of the illustrated arrangement is that the rider can, by positioning his chest against the upper portion of the seat, grip the side portions 50 and 52 of the seat with his elbows and forearms to control the board when starting in the water. From such a position, it is also quite easy for the rider to slide his knees alongside the seat to the riding position.

Referring again to FIGS. 1 and 2, it will be seen that in the illustrated riding position (with the rider holding onto a conventional ski towrope, not shown) the rider's buttocks remain in an elevated position above his ankles. As a result, a significant portion of the rider's weight is transferred to the board through the seat and not through the rider's ankles. This appreciably improves the comfort of the rider. In addition, this arrangement also positions the rider's weight slightly forward so that it can be positioned generally over the transverse centerline of the board. It has been found that this position reduces the bounce that is characteristic of other known skimming devices.

While a preferred embodiment of the invention has been illustrated and described, it will be understood that various modifications and alternative arrangements can be provided without departing from the inventive principles hereof. For example, other configurations of the seat could be provided. As well, means other than the curved side portions of the seat could be utilized to enable the rider to grip the seat between his legs while riding the waterslide or during takeoff from the position in the water.

One of ordinary skill, after reading the foregoing specification, will be able to effect various other modifications and substitutions of equivalents without departing from the broad concepts disclosed herein. It is therefore intended that the protection afforded by Letters Patent granted hereon be limited only by the definition contained in the appended claims and equivalents thereof.

The embodiments of the invention in which an exclusive property or privilege is claimed are defined as follows:

1. A recreational waterslide comprising:

a board having an upper surface and a lower surface, said lower surface being constructed and arranged to skim across the surface of a body of water, said upper surface being adapted to be mounted by a rider; and a seat secured to the upper surface of said board and positioned so as to be straddled by the legs of the rider, said seat including an upper portion that is adapted to engage the buttocks of a rider, said upper portion being spaced a predetermined distance from the upper surface of said board such that when a rider is seated in a kneeling position, the buttocks of the rider are elevated above the ankles of said rider, said seat having surface portions on opposite sides thereof that curve from the upper surface of said seat concavely inward to the upper surface of said board to define grips that are engageably by the lower portions of the legs of said rider.

2. A recreational waterslide comprising:

a board having an upper surface and a lower surface joined together along side edges, said lower surface being constructed and arranged to skim across the surface of a body of water; and a seat, said seat being secured to the upper surface of said board inwardly from the side edges thereof so as to be straddled by the lower legs of a rider, said seat being constructed and arranged to be sat upon by a rider in a kneeling position and to support the buttocks of the rider in an elevated position above the ankles of said rider, said seat having an upper portion and a lower portion, said upper portion being adapted to engage the buttocks of a rider, said lower portion being of reduced cross-sectional dimension relative to said upper portion and externally configured to provide gripping surfaces for the lower portions of the legs of said rider.

3. The waterslide of claim 1, wherein the upper portion of said seat has a saddle shape.

4. The waterslide of claim 3, wherein said board and said seat comprise a molded, single piece of plastic material.

5. The waterslide of claim 1 wherein the upper portion of said seat includes an upper surface having a front peak and a rear peak, said upper surface curving concavely downward between said front and rear peaks, the transverse dimension of said seat in the vicinity of said front peak being less than the transverse dimension of the seat in the vicinity of the rear peak, said upper surface including port and starboard lateral side edges that are opposed to one another and that curve concavely inward between said front and rear peaks.

6. The waterslide of claim 2, wherein the upper portion of said seat is saddle-shaped and wherein said opposed side portions curve concavely inward from said upper portion to the upper surface of said board.

7. The waterslide of claim 6, wherein said board and said seat comprise a molded, single piece of plastic material.

8. The waterslide of claim 2, wherein the upper portion of said seat includes an upper surface having a front peak and a rear peak, said upper surface curving concavely downward between said front and rear peaks, the transverse dimension of said seat in the vicinity of said front peak being less than the transverse dimension of the seat in the vicinity of the rear peak, said upper surface including port and starboard lateral side edges that are opposed to one another and that curve concavely inward between said front and rear peaks.

* * * * *